US005181451A

United States Patent [19]

Geuns et al.

[11] Patent Number: 5,181,451

[45] Date of Patent: Jan. 26, 1993

[54] CONTROL SYSTEM FOR LONGWALL FACE SUPPORT FRAMES

[75] Inventors: Guy Geuns, Wuppertal; Werner Reinelt, Bochum, both of Fed. Rep. of Germany

[73] Assignee: Hermann Hemscheidt Maschinenfabrik GmbH & Co., Wuppertal, Fed. Rep. of Germany

[21] Appl. No.: 716,924

[22] Filed: Jun. 18, 1991

[30] Foreign Application Priority Data

Jun. 20, 1990 [DE] Fed. Rep. of Germany ..... 4019607

[51] Int. Cl.[5] ..... F01B 1/00; F01B 7/00

[52] U.S. Cl. ..... 91/170 MP; 91/459; 91/518; 91/447; 417/303; 417/442; 60/427

[58] Field of Search ..... 91/170 R, 170 MP, 459, 91/178, 514, 518, 519, 447, 446, 448; 60/427; 417/302, 303, 440, 442

[56] References Cited

U.S. PATENT DOCUMENTS 4,473,324 9/1984 Cook ..... 91/170 MP
4,485,724 12/1984 Demircan et al. ..... 91/170 MP
4,622,803 11/1986 Lech ..... 91/433
4,718,329 1/1988 Nakajima et al. ..... 91/459
5,040,367 8/1991 Kauss ..... 91/447

FOREIGN PATENT DOCUMENTS 1079860 8/1967 United Kingdom ..... 91/170 MP
1160451 8/1969 United Kingdom .

*Primary Examiner*—Edward K. Look
*Assistant Examiner*—Hoang Nguyen
*Attorney, Agent, or Firm*—Dickinson, Wright, Moon, Van Dusen & Freeman

[57] ABSTRACT

A control system for longwall face support frames as used in mines, the system comprising pushing rams which are adapted to be actuated at two different pressures (for example, a low pressure of about 70 to 120 bar for non-defined cutting and a high pressure of 120 to 350 bar for defined cutting) with each pushing ram being individually actuatable by a respective non-return valve arrangement, the pushing rams being connected by a common pressure line to an hydraulic pressure unit.

7 Claims, 2 Drawing Sheets

CONTROL SYSTEM FOR LONGWALL FACE SUPPORT FRAMES

Figure 1:
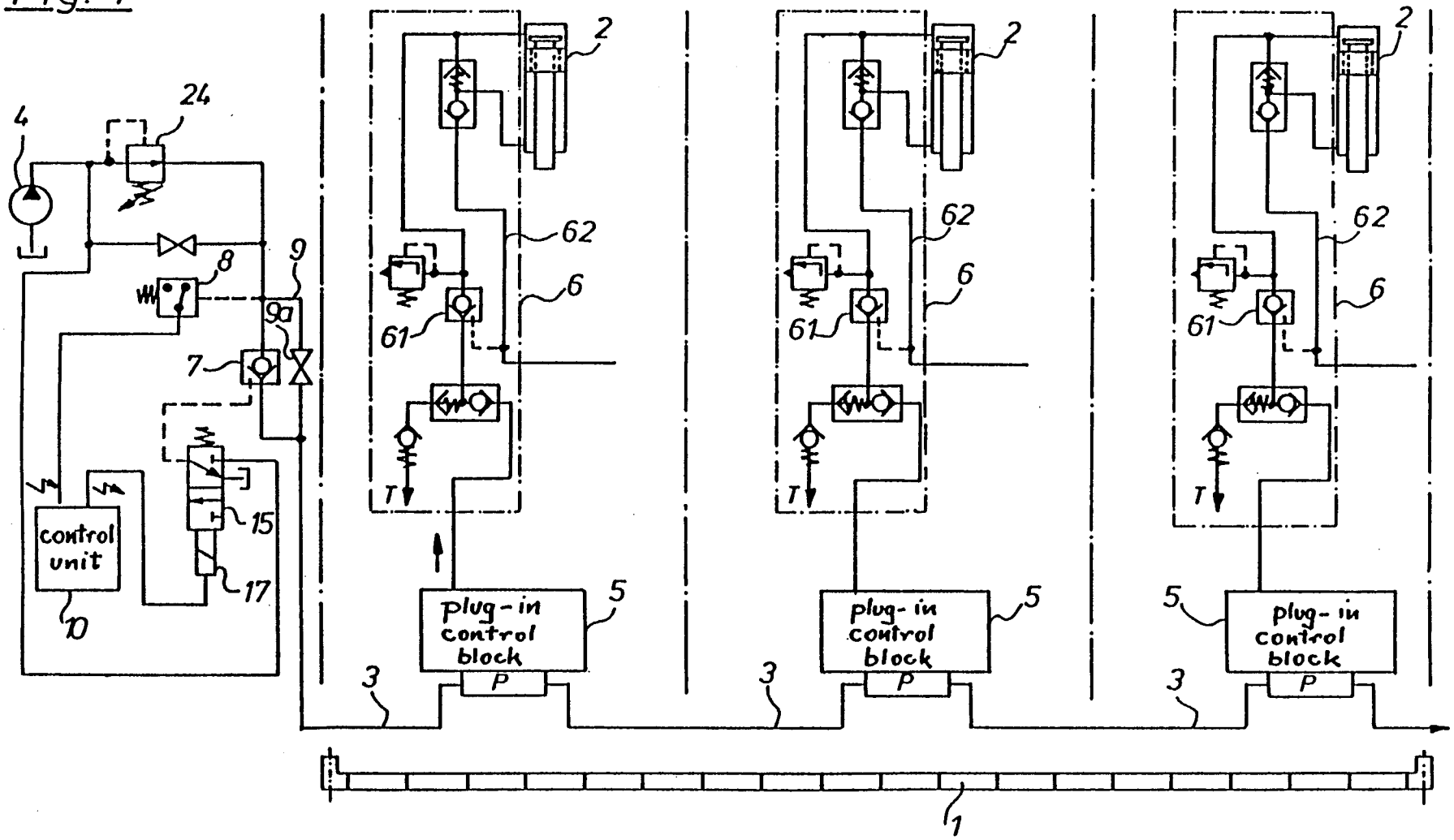

The invention relates to a control system for longwall face support frames.

In the case of coal-mining by cutting in automatic longwall faces, it is known for the conveyor to be moved backwards by pushing rams at a constant hydraulic pressure (e.g., a low pressure of about 80 to 120 bar), each movement being equal to the depth of cutting. The pushing rams serve as an hydraulic spring. Owing to variations in the partial strength of the coal, the cutting machine does not cut to a uniform depth, with the result that the working face and the movement of the conveyor is non-uniform and undulating, and this increases as mining proceeds. In this method the pushing rams are operated at low pressure, to prevent the cutting machine from jamming. It is therefore necessary to lay a separate low-pressure line in the longwall face. This method will hereinafter be called "non-defined cutting".

It is known from DE-AS 15 33 776 to avoid an undulating working face by limiting the extended length of the pushing rams to a defined, predetermined depth of cutting, so that the machine always cuts to a defined depth which can be reliably maintained. During the working travel of the cutting machine, the supply of pressure medium to the pushing rams is cut off, so that the cutting machine abuts rigidly against the liquid column of the pushing cylinder. The last-mentioned process will hereinafter be called "defined cutting". As before, pressure to the pushing rams is supplied through a separate low-pressure line.

The object of the invention, using defined cutting, is to reduce the cost of piping in the face and simultaneously ensure a high working speed and high reliability of operation.

According to the invention, this problem is solved by a control system for face support frames and comprising pushing rams which are actuated at two different pressures, i.e., a low pressure of about 70 to 120 bar for non-defined cutting and a high pressure of 120 to 350 bar for defined cutting, each pushing ram being individually actuatable by a respective non-return valve arrangement, and the pushing rams being connected by a common pressure line to an hydraulic pressure unit.

By means of the invention, therefore, a single pipe system in the face can be used for defined cutting, but mining can be continued during the intervals between defined cutting by using the "non-defined cutting" function.

According to another advantageous feature of the invention, a non-return valve actuated in dependence on the pressure of the pressure unit is disposed in the pressure line between the pressure unit and the pushing rams, actuation being by an electronic control unit via a 2/3-way valve actuated by an electromagnet so that the non-return valve is closed when the electromagnet drops out. This feature of the invention ensures that, when the electronic unit controlling defined cutting drops out, the pressure line cannot remain at the high pressure for defined cutting, and high pressure cannot build up automatically.

Figure 2:
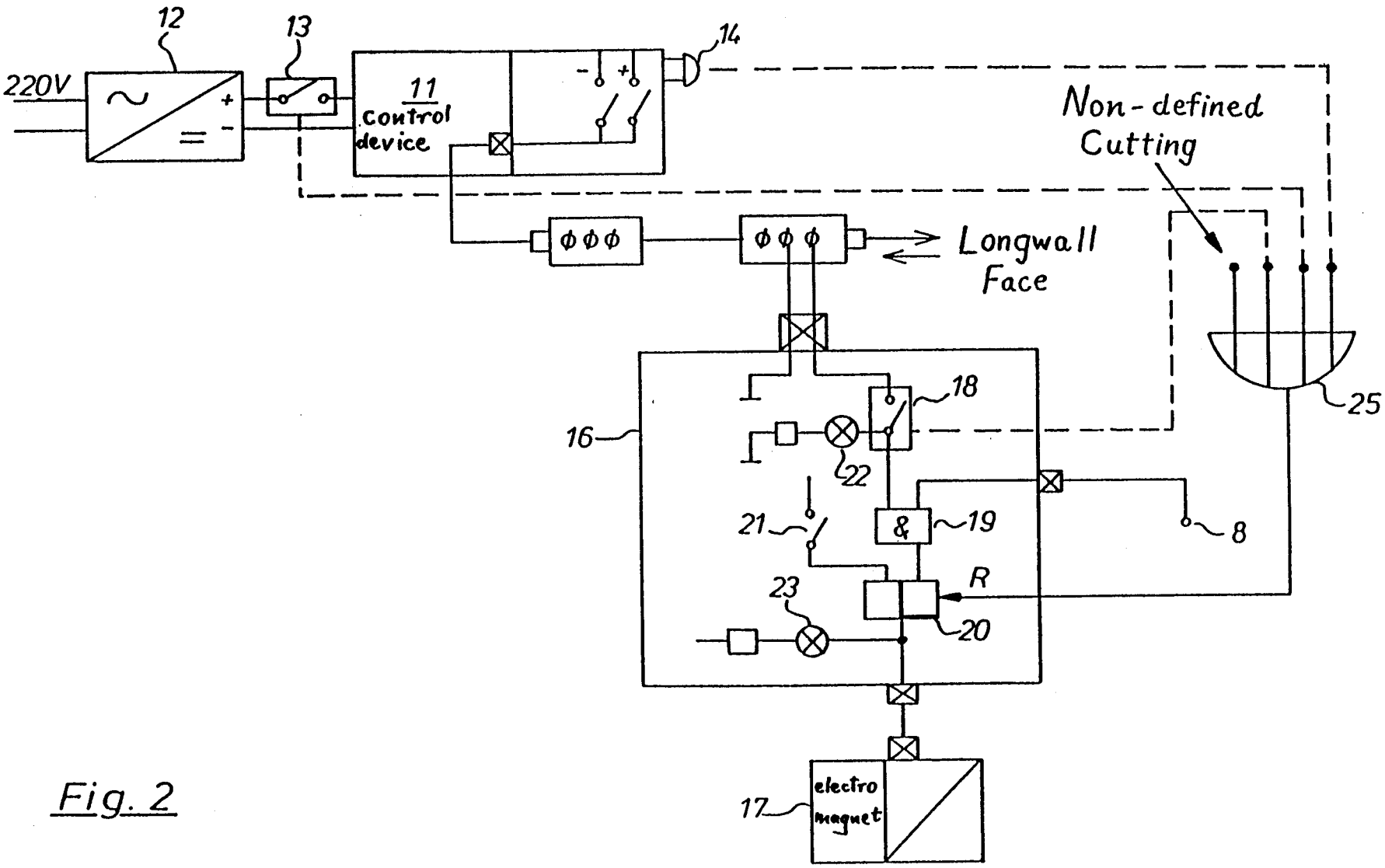

The invention will be explained in detail with reference to an embodiment shown in the accompanying drawings, in which :

FIG. 1 is a basic circuit diagram of a control system according to the invention; and FIG. 2 is a basic circuit diagram of a control unit in the control system in FIG. 1.

As FIG. 1 shows, a conveyor 1 is disposed in a longwall face and is acted upon by hydraulically-actuated pushing rams 2 disposed parallel to one another and belonging to support frames (not shown). FIG. 1 also omits the cutting machine, which extends parallel to conveyor 1. The pushing rams 2 are connected by a common pressure line 3 to an hydraulic pressure unit 4. The pressure unit 4 can supply the pushing rams 2 with a low pressure of about 80 to 120 bar for "non-defined cutting", and with a high pressure of up to about 350 bar for "defined cutting". The low pressure is generated from the high pressure by a pressure-reducing valve 24. The pushing rams 2 are each connected to the pressure line 3 by a plug-in control block 5 and a valve arrangement 6. When "defined cutting" is switched on, the plug-in control block 5 opens a non-return valve 61 and thus supplies high pressure to the piston chamber of the pushing ram 2. After the conveyor has moved, "defined cutting" is switched off, so that the non-return valve 61 closes and the piston of the pushing ram 2 rests on the liquid column of pressure medium. After the cutting operation, the plug-in block is tightened by pressurizing the line 62. According to another feature, a controllable non-return valve 7 is disposed in the pressure line 3 between the pressure unit 4 and the connections of the pushing ram 2. A pressure sensor (transducer) 8 is connected between the pressure unit 4 and the non-return valve 7. The non-return valve 7 can be bridged by a bypass line 9. The bypass line 9 can be manually opened or closed by means of a valve 9*a*. The non-return valve 7 is controlled by an electronic control unit 10 and a 2-portion, 3-way valve 15 actuated by an electromagnet 17, the control unit 10 being likewise connected to the pressure sensor 8.

FIG. 2 is a basic circuit diagram of the control unit 10. Unit 10 comprises a central control device 11 connected by a switch 13 to an e.g. 220 V a.c. voltage source 12. The central control device 11 supplies voltage to and controls all the other control devices and units. The control device 11 has an emergency button 14, or alternatively or additionally, the emergency function can be transmitted to the control device via lines from the longwall face. A control unit 16 which controls the electromagnet 17 is connected to the central control device 11. Electromagnet 17 (see FIG. 1) actuates the non-return valve 7 via the valve 15. The control unit 18 has an on/off locking switch 18 for making or breaking the connection between the central control device 11 and an AND element 19 in the control unit 16. The second input of AND element 19 is connected to the signal output of the pressure sensor 8. The output of AND element 19 is connected to the input of a self-locking storage stage 20. A second input of storage stage 20 is connected, depending on voltage, to an "ON" button 21. Displays 22, 23 are also provided for showing when switches 18 and 21 are on. The output of the storage stage 20 is connected to electromagnet 17 which, via the valve 15, actuates the non-return valve 7 so that, when electromagnet 17 drops out, the non-return valve 7 is closed. The self-locking storage stage 20 also has a reset input R connected to the output of an OR element 25. The OR element 25 has four inputs, one being connected to switch 13. The second input is connected to the emergency button 14, the third input is connected to the on/off locking switch 18 and the fourth input leads to the switch (not shown) for "non-defined cutting".

By means of the previously-described control via the reset connection R of the self-locking storage stage 20, the electromagnet 17 drops out and consequently closes the non-return valve 7 when the emergency button 14 is actuated or when the on/off locking switch 18 is "off" or when the voltage supply (220 V) is disconnected by switch 13 or when "non-defined cutting" is switched on. As a result of the previously-described control unit, the electromagnet 17 can be switched on, thus opening the non-return valve 7, only when the operating voltage is switched on by switch 13 and the on/off locking switch 18 is on and the emergency button 14 is not actuated or has been returned to the inoperative position and the pressure is below the minimum pressure $P_{min}$ and "defined cutting" is input and the "on" button 21 has been actuated. The pressure sensor 8 operates as follows: when the pressure falls below the minimum, an output signal is generated so that an "on" signal appears at one input of the AND element 19. The minimum pressure $P_{min}$ is the pressure at which defined cutting ceases to be possible. The minimum pressure can be about 150 bar. This function ensures that, when "defined cutting" stops, the entire plant is put out of operation, since the non-return valve 7 closes and thus interrupts the pressure supply to the pushing rams 2.

The invention thus ensures that, after an interruption of operation, e.g. a fault, "defined cutting" cannot be automatically reset but needs to be switched on deliberately after the fault has been repaired, thus always ensuring that the pressure is below $P_{min}$.

The control unit according to the invention also enables "non-defined cutting" to carry on during the intervals between "defined cutting". To this end, the closed non-return valve 7 is bridged by bypass 9, by opening the valve 9*a*. The bypass 9 is opened by hand.

We claim:

1. A control system for longwall face support frames as used in mines, the control system comprising pushing rams adapted to be actuated at two different pressures, namely, one pressure for non-defined cutting and the other pressure for defined cutting, a respective non-return valve arrangement for each pushing ram whereby each ram is individually actuable by its respective non-return valve arrangement, a common pressure line connecting the pushing rams to a hydraulic pressure unit, a further non-return valve arranged to be actuated in dependence on the pressure of the hydraulic pressure unit and disposed in the common pressure line between the hydraulic pressure unit and the pushing rams, and an electronic control unit arranged to actuate the further non-return valve via two-position valve actuated by an electromagnet so that the further non-return valve is closed when the electromagnet drops out.

2. A control system according to claim 1, wherein the electromagnet is arranged to be actuated by a pressure sensor whereby the electromagnet in the pressure line can be switched on only when the pressure falls below a minimum pressure at which defined cutting ceases to be possible.

3. A control system according to claim 2, wherein the electromagnet is arranged to be actuated by a control device forming part of the electronic control unit, the control device having an on/off locking switch connected to an AND element the other input of which is connected to the pressure-sensor for measuring the pressure in the common pressure line, the output of the AND element being connected to a self-locking storage stage the second input of which is connected to an ON button while its output is connected to the electromagnet whereby the electromagnet can be switched on only when the said ON button is actuated and when the pressure at the pressure sensor falls below the minimum pressure.

4. A control system according to claim 3, wherein the electronic control unit, including the control device, is connected to a source of operating voltage via a voltage supply switch.

5. A control system according to claim 4, wherein an emergency button is connected behind the voltage supply switch and, in the off-state, connects the electronic control unit to the voltage supply switch.

6. A control system according to claim 3, wherein the self-locking storage stage has a reset input connected to the output of an OR element, and the OR element has four inputs the first of which is connected to the voltage supply circuit, the second is connected to the emergency button, the third is connected to an emergency locking switch, and the fourth is connected to the switch for "non-defined cutting".

7. A control system according to claim 1, wherein the pressure for non-defined cutting lies within the range of about 70 to 120 bar, while the pressure for defined cutting lies within the range of 120 to 350 bar.

* * * * *